US005092061A

United States Patent [19]

Jackl et al.

[11] Patent Number: 5,092,061

[45] Date of Patent: Mar. 3, 1992

[54] CALENDAR ATTACHMENT FOR A WATCHBAND

[75] Inventors: Werner Jackl, Coventry, R.I.; Richard E. Ripley, Attleboro, Mass.

[73] Assignee: Textron Inc., Providence, R.I.

[21] Appl. No.: 528,141

[22] Filed: May 24, 1990

[51] Int. Cl.[5] ..... G09D 3/10

[52] U.S. Cl. ..... 40/117; 368/41

[58] Field of Search ..... 40/116–118, 40/633, 107, 111; 368/28, 31–40

[56] References Cited

U.S. PATENT DOCUMENTS

| | | | |
|---|---|---|---|
| 1,553,375 | 9/1925 | Gashyesva | 40/118 |
| 1,770,769 | 7/1930 | Faireg | 40/117 |
| 1,968,444 | 7/1934 | Farber | 40/117 |
| 3,526,985 | 9/1970 | Rieth | 40/117 |
| 3,585,744 | 6/1971 | Arnone | 40/633 |
| 3,611,602 | 10/1971 | Gandelman et al. | 40/117 |
| 3,619,923 | 11/1971 | Bruner | 40/118 |
| 3,698,113 | 10/1972 | Spicer | 40/118 |
| 4,903,250 | 2/1990 | Cho | 368/41 |

FOREIGN PATENT DOCUMENTS

| | | | |
|---|---|---|---|
| 0614327 | 12/1926 | France | 40/633 |

*Primary Examiner*—Kenneth J. Dorner
*Assistant Examiner*—James M. Gardner
*Attorney, Agent, or Firm*—Samuels, Gauthier & Stevens

[57] ABSTRACT

A calendar attachment for a watchband in which a case cooperates with a windowed cover to define a chamber adapted to receive a calendar cartridge. The cartridge includes an elongated flexible calendar strip extending over a platen and connected at its opposite ends to a pair of shafts rotatably supported beneath the platen. The shafts are mechanically interconnected by intermeshed gears, and one of the shafts has an operating stem protruding externally of the chamber.

7 Claims, 3 Drawing Sheets

CALENDAR ATTACHMENT FOR A WATCHBAND

BACKGROUND OF THE INVENTION

1. Field of the Invention

This invention relates to a calendar attachment adapted to be interconnected with and to serve as an integral part of a watchband.

2. Description of the Prior Art

The calendar attachments for watchbands which have been developed in the past are all deficient in one or more respects. For example, some embody calendar strips which are either fabricated from special materials such as spring steel, or specially configured with perforated or grooved edges to coact with the advancement mechanisms. This contributes significantly to the cost of the attachments, often pricing them out of the market.

Other attachments embody unduly complicated advancement mechanisms which are overly prone to malfunctioning. Still others include operating knobs o cogged wheels which partially protrude through the tops of the attachments. Rotation of such knobs or wheels carries dust, dirt and other contaminants into the advancement mechanisms, again causing malfunctions.

Examples of known prior art calendar attachments for watchbands are disclosed in U.S. Pat. Nos. 1,553,375; 1,968,444; 3,526,985; 3,611,602; 3,619,923; and 3,698,113.

SUMMARY OF THE INVENTION

A general objective of the present invention is to provide an improved calendar attachment for a watchband which obviates or at least significantly minimizes the problems and drawbacks associated with the prior art.

A more specific objective of the present invention is the provision of a calendar attachment for a watchband which employs a mechanically simple and low cost advancement mechanism designed to operate in conjunction with a plain low cost strip of calendar indicia, thereby making it possible to significantly lower the overall cost of the unit while at the same time maximizing its operational reliability.

A companion objective of the present invention is the provision of a calendar attachment for a watchband having a single operating stem protruding centrally through a side of the case, thereby contributing to an aesthetically balanced appearance while also making it possible to more effectively safeguard against contamination of the internal advancement mechanism.

Other objects and advantages of the present invention will be described in greater detail with reference to the accompanying drawings, wherein:

DETAILED DESCRIPTION OF ILLUSTRATED EMBODIMENT

Figure 1:
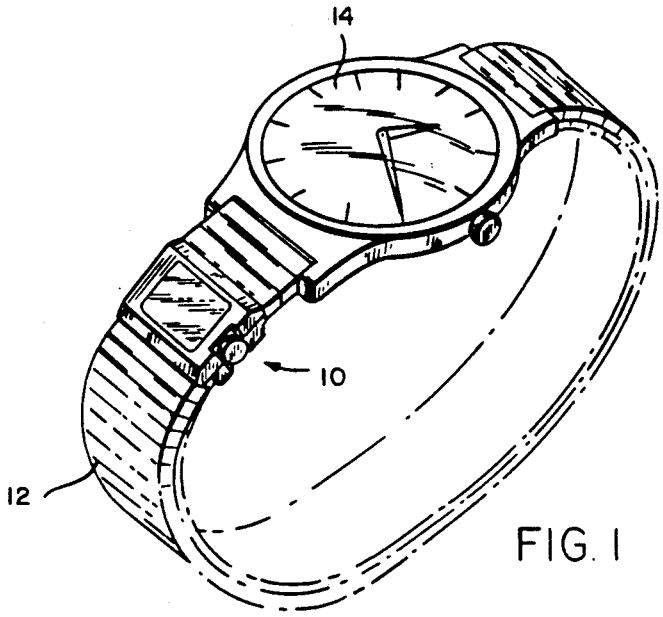
FIG. 1 is a perspective view of a calendar attachment according to the present invention, shown incorporated as part of a conventional expansible watchband.
Figure 3:
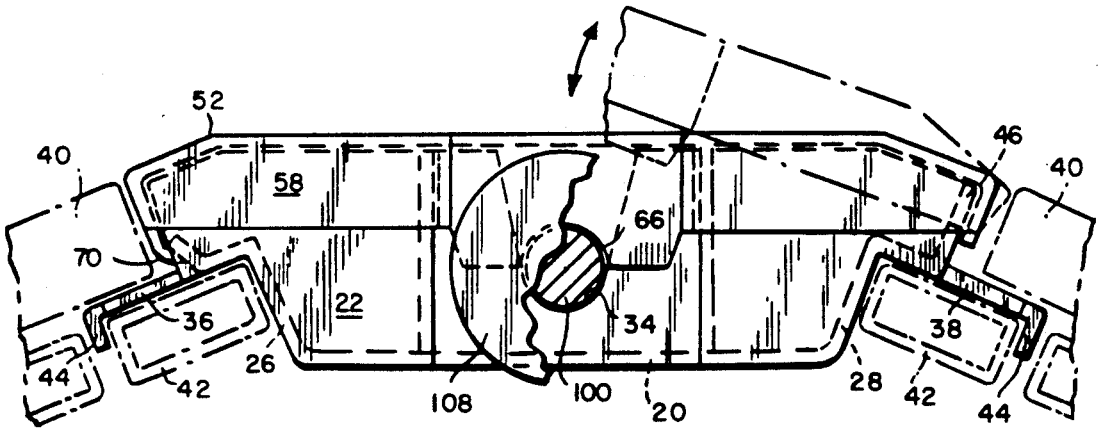
FIGS. 3, 4, 5 and 6 are sectional views taken respectively along lines 3—3, 4—4, 5—5 and 6—6 of FIG. 2.

Referring initially to FIG. 1, a calendar attachment for a watchband in accordance with a preferred embodiment of the present invention is generally depicted at 10. The attachment is incorporated as an integral part of a conventional expansion type watchband 12 at a location adjacent to one side of the wristwatch 14.

With additional reference to the remaining drawings, it will be seen that the watchband attachment includes an outer case 16 and a cover 18. The case has a bottom wall 20 with confronting side walls 22,24 and confronting end walls 26,28 extending upwardly therefrom. The side and end walls surround and define an access opening 30 leading to an interior casing chamber 32. One casing side wall 22 is centrally recessed at 34.

Figure 5:
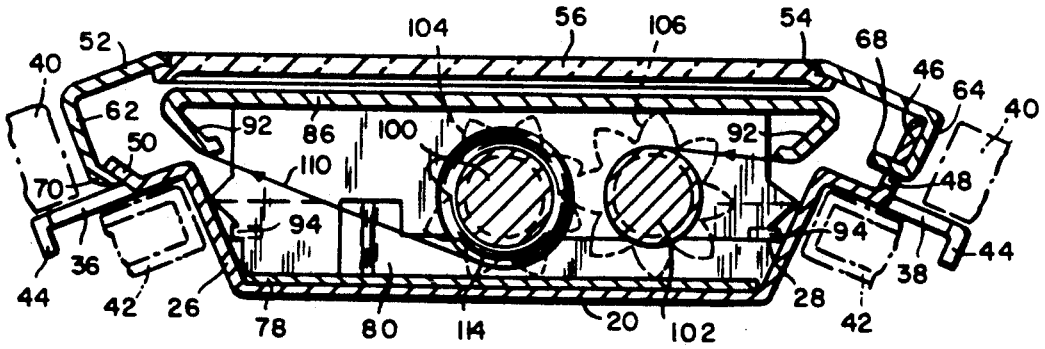
Figure 6:
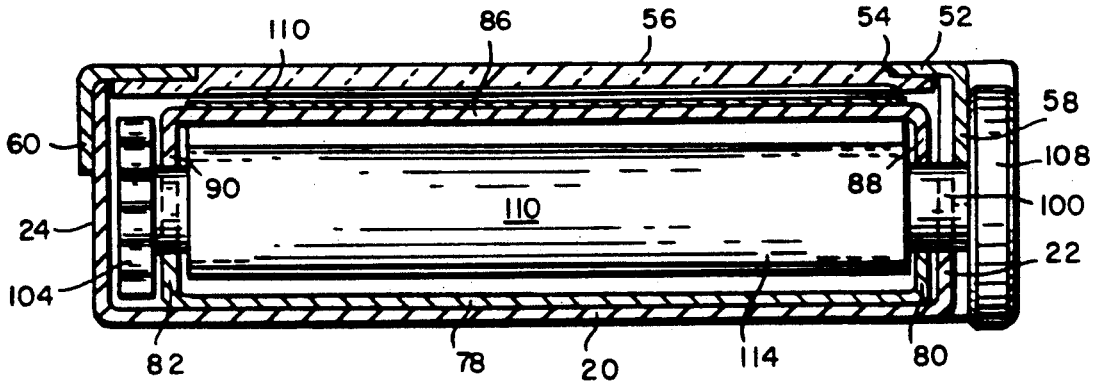

The casing end walls 26,28 each include respective angled flanges 36,38 which extend between the adjacent top and bottom bracelet links 40,42 for connection thereto in a known manner, for example by having their ends bent downwardly as at 44. An upstanding segment 46 coacts with flange 38 to define a pair of slots, one being shown at 48 in FIG. 5. The opposite flange 36 has an upturned angled tab 50.

Figure 4:
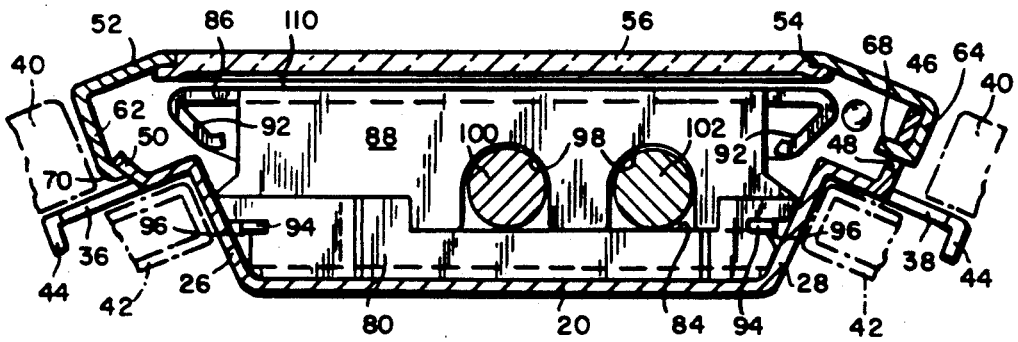
Figure 2:
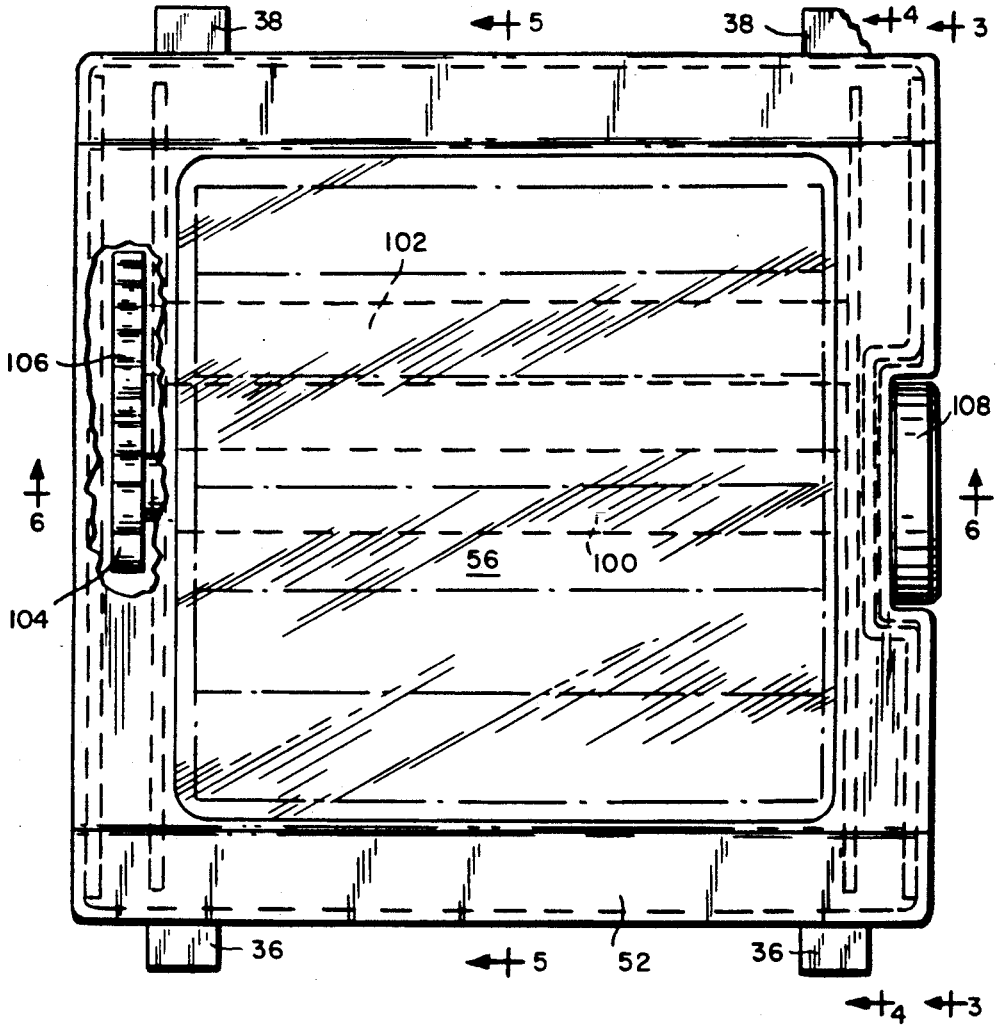
FIG. 2 is a top plan view of the calendar attachment shown in FIG. 1.
Figure 7:
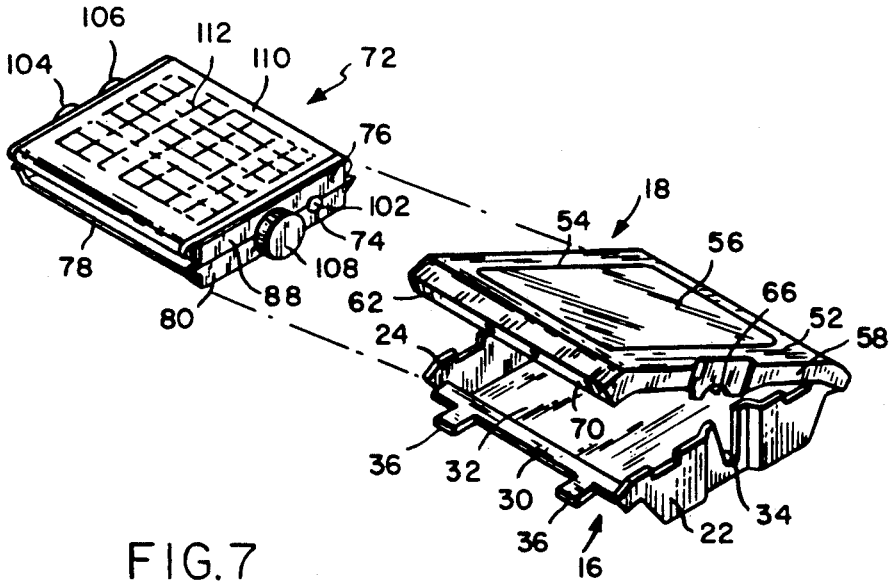
FIG. 7 is an exploded perspective view showing the cover open and the calendar cartridge removed from the case.

Cover 18 has a top wall 52 with a generally rectangular window 54 in which is mounted a transparent panel 56 Side walls 58,60, and end walls 62,64 depend from the top cover wall 52. Side wall 58 is centrally recessed at 66. End wall 64 includes inwardly protruding tabs 68 arranged to be received in and to coact with the casing slots 48 in providing a hinge mechanism pivotally connecting the cover to the case. This hinge mechanism permits the cover to be pivoted between a closed position as shown for example in FIGS. 1 and 2 and an open position as shown in FIG. 7 (also depicted schematically by the broken lines in FIG. 4). When in the open position, the cover allows access to the chamber 32 via access opening 30. When closed, the cover blocks the access opening and permits the interior of the chamber 32 to be viewed through the window 54. The lower edge of cover end wall 62 forms a resilient catch lip 70 arranged to overlap and coact with the upturned angled tab 50 in releasably holding the cover in the closed position.

A calendar cartridge 72 is removably received in the casing chamber 32 through access opening 30 when the cover is in the open position, as shown in FIG. 7. Cartridge 72 includes a lower portion 74 and an upper portion 76. The lower portion has a bottom wall 78 and upstanding side walls 80,82, each having a single recess 84. The top portion 76 has a top wall defining a platen 86, with side walls 88,90 and angled end lips 92 depending downwardly therefrom. The side walls 88,90 have tabs 94 which are bent into notches 96 in the side walls 78,80 to integrally join the upper portion 76 to the lower portion 74. The side walls 88,90 each have pairs of mutually spaced recesses 98 which coact with the single recesses 84 in the side walls of the lower portion to jointly define apertures in which are journalled a pair of shafts 100,102. The shafts 100,102 extend in parallel relationship beneath the platen 86. Intermeshed gears 104,106 are mounted on the shaft ends protruding from one cartridge side. The opposite end of shaft 100 protrudes from the opposite cartridge side and carries a knob 108.

Cartridge 72 further includes an elongated strip 110 with calendar indicia 112 (see FIG. 7) sequentially arranged along the length thereof. Opposite ends of the strip are secured respectively to the shafts 102,104. An intermediate portion of the strip overlies the platen 86, with a supply of said strip being wound as at 114 around at least one of the shafts. The end lips 92 serve as guides to direct the strip from the platen to the shafts 100,102.

With the cover 18 open as shown in FIG. 7, the cartridge 72 may be inserted through the access opening 30 into the chamber 32. The protruding end of shaft 102 will extend across the recess 34 in side wall 22, with the operating knob 108 thus being externally positioned. The cover 18 is then snapped closed to confine the cartridge within the chamber 32, with the calendar indicia on that portion of the strip 110 overlying the platen 86 being visible through the window 54. The strip 110 may be advanced in either direction by appropriate rotation of the single knob 108.

The strip 110 is completely free of notches, grooves, etc. and thus can comprise inexpensive paper on which the calendar indicia may be printed in a cost-effective manner. The single external knob 108 is centrally located to one side of the attachment, and by closely configuring the recesses 34,66 in the side walls 22,58 of the case and the cover, ingress of dirt and other contaminants can be largely eliminated.

At the appropriate time, a spent cartridge can be replaced with a fresh cartridge by simply opening the cover 18 to gain access to the interior chamber 32. This can be done by simply releasing the resilient catch lip 70 from coactive engagement with the casing tab 50, and without the need to employ special tools.

We claim:

1. A calendar attachment for a watchband, said attachment comprising:

a case defining a chamber accessible through an access opening;

a cover having a window;

means for attaching said cover to said case for pivotal movement between an open position allowing access to said chamber through said access opening, and a closed position closing said access opening and permitting the interior of said chamber to be observed through said window;

a calendar removably received in said chamber through said access opening when said cover is in the open position, said cartridge having a platen with oppositely disposed side walls depending downwardly therefrom and an elongated flexible strip overlying said platen and provided with calendar indicia sequentially arranged along the length thereof, said indicia being observable through said window when said cover is closed to confine said window when said cover is closed to confine said cartridge within said chamber, said cartridge being further provided with drive means for longitudinally shifting said strip in opposite directions past said window, said drive means being operable by means of a single rotatable stem protruding exteriorly of said chamber, said drive means including parallel rotatable shafts extending beneath said platen and through openings in said side walls, said strip having opposite ends connected to said shafts with a supply of said strip wound around at least one of said shafts, each of said shafts being provided with a gear, said gears being meshed one with the other to mechanically interconnect said shafts, said stem being carried on an end of one of said shafts.

2. The calendar attachment of claim 1 wherein said case has a bottom wall, with said access opening being defined by confronting first and second side and end walls extending upwardly from said bottom wall, and means for securing said end walls to said watchband.

3. The calendar attachment of claim 2 wherein a first end of said cover is attached to the first of said case end walls for pivotal movement between said open and closed positions, and wherein a second end of said cover is provided with catch means releasably coacting with the second case end wall to maintain said cover in the closed position.

4. The calendar attachment of claim 3 wherein said catch means is comprised of a resilient lip on said cover arranged to overlap a flange on said case.

5. The calendar attachment of either claim 1 wherein said cartridge includes integrally joined mating top and bottom portions, said platen comprising a part of said top portion, and said openings being jointly defined by said top and bottom portions.

6. The calendar attachment of claim 1 wherein the said one of said shafts is arranged centrally with respect to the length of said attachment is measured in the direction of longitudinal movement of said strip.

7. A calendar attachment for a watchband, said attachment comprising:

a case defining a chamber accessible through an access opening;

a cover having a window;

means for attaching said cover to said case for pivotal movement between an open position allowing access to said chamber through said access opening, and a closed position closing said access opening and permitting the interior of said chamber to be observed through said window;

a calendar cartridge removably received in said chamber through said access opening when said cover is in the open position, said cartridge having a platen with oppositely disposed downwardly extending side walls and an elongated flexible strip with calendar indicia sequentially arranged along the length thereof, said indicia being observable through said window when said cover is closed to confine said cartridge within said chamber, said cartridge being further provided with drive means for longitudinally shifting said strip in opposite directions past said window, said drive means being operable by means of a single rotatable stem protruding exteriorly of said chamber, said drive means including parallel rotatable shafts extending beneath said platen and through openings in said side walls, said strip having opposite ends connected to said shafts, with a supply of said strip wound around at least one of said shafts and with an intermediate portion of said strip overlying said platen, said cartridge being formed from integrally joined mating top and bottom portions, said platen comprising a part of said top portion and said openings being jointly defined by said top and bottom portions.

* * * * *